US010060069B2

(12) United States Patent
Park et al.

(10) Patent No.: US 10,060,069 B2
(45) Date of Patent: Aug. 28, 2018

(54) LAUNDRY TREATMENT MACHINE

(71) Applicant: LG ELECTRONICS INC., Seoul (KR)

(72) Inventors: Youngbae Park, Changwon-si (KR); Jimaeng Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 271 days.

(21) Appl. No.: 14/063,110

(22) Filed: Oct. 25, 2013

(65) Prior Publication Data

US 2014/0116096 A1 May 1, 2014

(30) Foreign Application Priority Data

Oct. 25, 2012 (KR) ..... 10-2012-0119174

(51) Int. Cl.
*D06F 39/14* (2006.01)

(52) U.S. Cl.
CPC ..... *D06F 39/14* (2013.01)

(58) Field of Classification Search
CPC ..... D06F 39/14; D06F 39/12; D06F 37/28; D06F 37/26; D06F 37/10; D06F 37/18; A47L 15/4259; A47L 15/4261; A47L 15/4263; A47L 15/4265; A47L 15/4257; E05F 11/54
USPC ..... 312/228, 326, 237, 319.1, 319.6, 328, 312/329, 405; 68/12.26, 196; 292/95, 292/100, 198, 341.17; 49/394, 67, 70; 70/451
See application file for complete search history.

(56) References Cited

U.S. PATENT DOCUMENTS 5,620,213 A * 4/1997 Ellis ..... E05B 13/10 292/100
2006/0090523 A1 5/2006 Lyu

FOREIGN PATENT DOCUMENTS

| | | | |
|---|---|---|---|
| CN | 201232124 | Y | 5/2009 |
| CN | 102199863 | A | 9/2011 |
| EP | 2 402 499 | A1 | 1/2012 |
| JP | H 7-24188 | A | 1/1995 |
| JP | 2006-101966 | A | 4/2006 |
| JP | 2008-029371 | | 2/2008 |

(Continued)

OTHER PUBLICATIONS

Korean Office Action dated Dec. 29, 2014, issued in Application No. 10-2012-0119174.

(Continued)

*Primary Examiner* — Michael E Barr
*Assistant Examiner* — Tinsae B Ayalew
(74) *Attorney, Agent, or Firm* — KED & Associates LLP

(57) ABSTRACT

A laundry treatment machine is provided. The laundry treatment machine may include a top cover, a control panel, a lid assembly, and a lid handle. The top cover may be disposed over a cabinet and have a laundry loading hole. The control panel may be disposed at a front upper side of the top cover. The lid assembly may be disposed over the top cover at a rear side of the control panel and open/close the laundry loading hole. The lid handle may protrude in a forward direction from a front surface of the lid assembly and protrude in an upward direction with respect to a top surface of the lid assembly to form a gap such that a hand of a user may enter the gap between the lid handle and the control panel.

20 Claims, 4 Drawing Sheets

(56) References Cited

FOREIGN PATENT DOCUMENTS

| | | | | | |
|---|---|---|---|---|---|
| JP | 2008029371 | A | * | 2/2008 | |
| JP | 2012-011092 | | | 1/2012 | |
| KR | 10-2002-0030620 | A | | 4/2002 | |
| KR | 10-2005-0114337 | | | 12/2005 | |
| KR | 10-2008-0090043 | A | | 10/2008 | |
| KR | 20080090043 | A | * | 10/2008 | ..... D06F 39/14 |
| KR | 10-2011-0013136 | A | | 2/2011 | |

OTHER PUBLICATIONS

Chinese Office Action issued in Application No. 201310512145.5 dated Jun. 19, 2015.
Korean Office Action dated Sep. 18, 2015.
Australian Examination Report dated Sep. 28, 2015.
Japanese Office Action issued in Application 2013-222137 dated Oct. 3, 2017 (full Japanese text).

* cited by examiner

LAUNDRY TREATMENT MACHINE

CROSS-REFERENCE TO RELATED APPLICATION(S)

This application claims the priority to Korean Patent Application No. 10-2012-0119174, filed on Oct. 25, 2012, in the Korean Intellectual Property Office, the disclosure of which is incorporated herein by reference in its entirety.

BACKGROUND

1. Field

A laundry treatment machine is disclosed herein.

2. Background

Generally, laundry treatment machines include a washing machine that removes contaminants from clothing and bedding (hereinafter, referred to as laundry) using water, detergent, and mechanical action, a drying machine that dries wet laundry using hot air heated by a heater and mechanical action, a drying and washing machine that performs both a washing function and a drying function, and a refresher that sprays heated vapor to laundry to prevent allergies caused by laundry. The laundry treatment machines may further include various kinds of apparatuses that treat laundry by applying physical actions and chemical actions to laundry.

Laundry treatment machines may be classified according to a location of a laundry loading hole through which laundry is loaded and unloaded. Washing machines may be classified as a top load type, in which the laundry loading hole is formed at a top surface of a cabinet thereof and washing is performed by a whirling water generated when a washing tub rotates, or a drum type, in which the laundry loading hole is formed at a front surface of a cabinet thereof and washing is performed by the dropping of laundry during rotation of a drum. The top load type laundry treatment machines have a laundry loading hole formed in the top surface of the cabinet and a lid assembly disposed at an upper side of the cabinet to open/close the laundry loading hole.

BRIEF DESCRIPTION OF THE DRAWINGS

Embodiments will be described in detail with reference to the following drawings in which like reference numerals refer to like elements, and wherein.

DETAILED DESCRIPTION

The advantages and features and a way of attaining them will become apparent with reference to embodiments described below in detail in conjunction with the accompanying drawings. Embodiments, however, may be embodied in many different forms and should not be constructed as being limited to the exemplary embodiments set forth herein. Rather, these exemplary embodiments are provided so that this disclosure will be thorough and complete and will fully convey the scope to those skilled in the art. The scope of embodiments should be defined by the claims.

Wherever possible, the same reference numbers will be used throughout the drawings to refer to the same or like parts, and repetitive disclosure has been omitted.

Hereinafter, a laundry treatment machine (hereinafter, referred to as a 'washing machine') according to embodiments will be described in detail with reference to the accompanying drawings.

Figure 1:
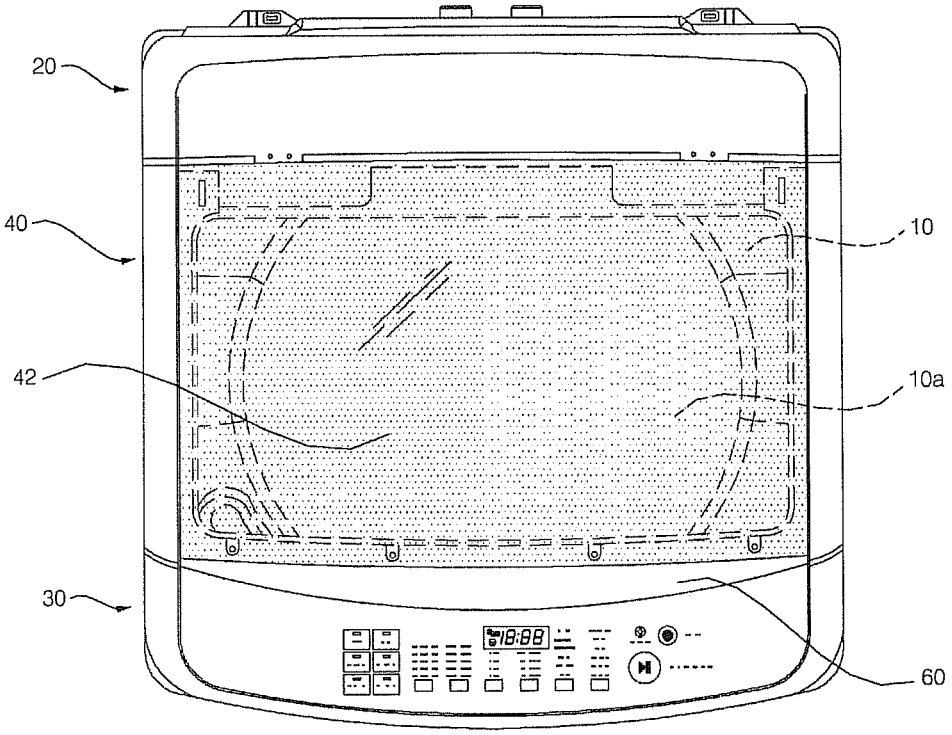
FIG. 1 is a plan view of a top surface of a washing machine according to an embodiment.
Figure 2:
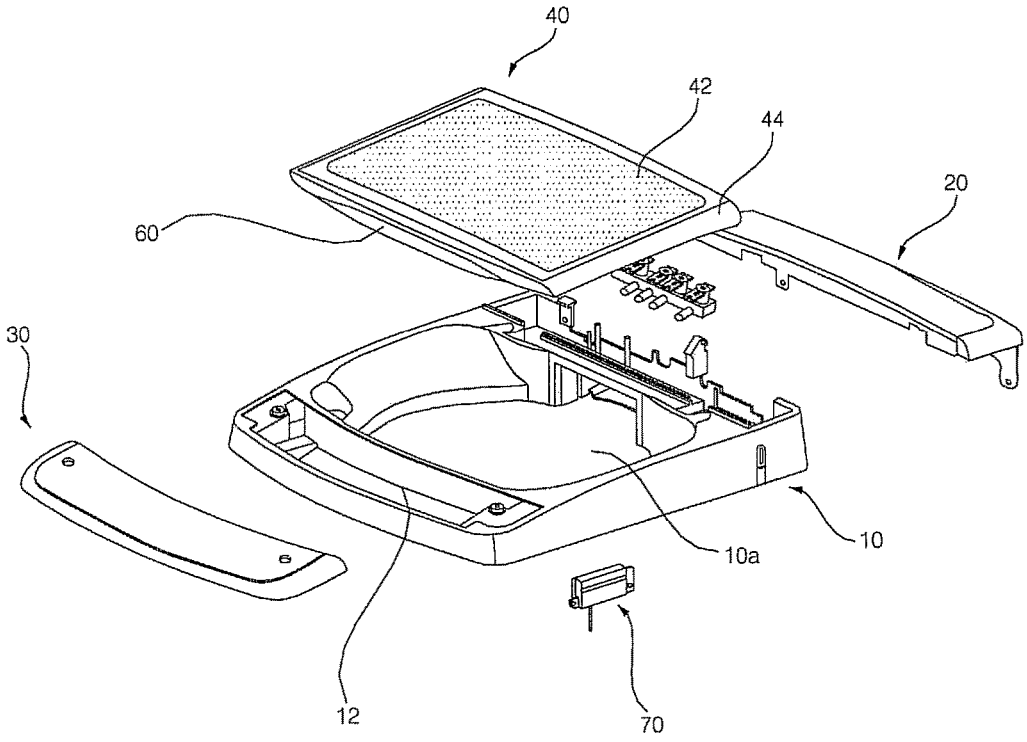
FIG. 2 is an exploded perspective view of a top cover and a lid assembly shown in FIG. 1.
Figure 3:
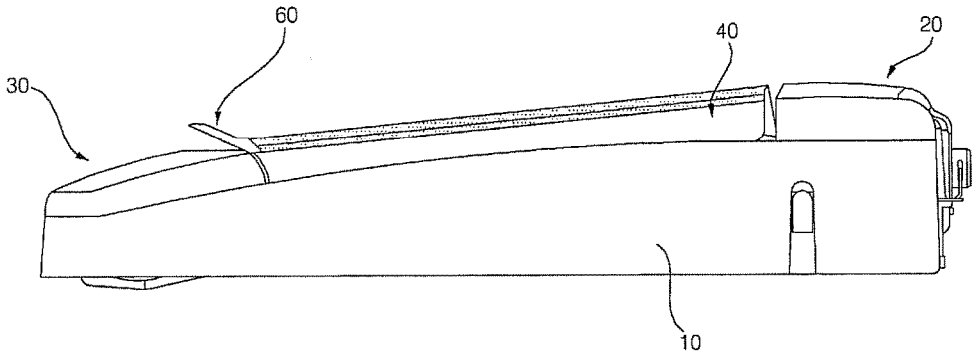
FIG. 3 is a side view of the top cover and the lid assembly of FIG. 2.

FIG. 1 is a plan view of a top surface of a washing machine according to an embodiment. FIG. 2 is an exploded perspective view of a top cover and a lid assembly shown in FIG. 1. FIG. 3 is a side view of the top cover and the lid assembly of FIG. 2.

Referring to FIG. 1, the laundry treatment machine may include a cabinet (not shown), a top cover 10, a rear panel 20, a control panel 30, a lid assembly 40, and a lid handle 60. The top cover 10 may be disposed at an opened top surface of the cabinet (not shown), and may have a laundry loading hole 10*a* formed therein. A detergent box (not shown) containing a detergent, a water supply apparatus (not shown) to guide water from the outside to the detergent box, and a control board 34 to control an operation of the washing machine may be disposed at or on the top cover 10. The top cover 10 may include a seat 12 provided at a front upper side of the top cover 10, in which the control board 34 may be disposed. A lid lock assembly 70 may be disposed at or on the top cover 10 to lock the lid assembly 40. A top surface of the top cover 10 may be covered by the control panel 30, the lid assembly 40, and the rear panel 20.

The control panel 30 may be disposed at the front upper side of the top cover 10. The control panel 30 may cover the control board 34 disposed in the seat 12. The control panel 30 may include a plurality of function buttons to set the operation of the washing machine and a display (not shown) to display a state of the washing machine.

The rear panel 20 may be disposed at a rear upper side of the top cover 10, and may cover an upper portion of the water supply apparatus (not shown).

The lid assembly 40 may be disposed at a central upper side of the top cover 10, and may open/close the laundry loading hole 10*a*. The lid assembly 40 may be pivotably disposed at or on the top cover 10. The lid assembly 40 may include an upper lid panel 42, and a lower lid panel 44.

The upper lid panel 42 may define an upper exterior of the lid assembly 40. In this embodiment, the upper lid panel 42 is shown as being formed of a glass material. However, embodiments are not limited thereto. For example, the upper lid panel 42 may include a glass portion, and a frame portion that supports a circumference of the glass portion and is coupled to the lower lid panel 44.

The lower lid panel 44 may be coupled to a lower portion of the upper lid panel 42. The lower lid panel 44 may be formed to have a frame shape so as to support a lower circumference of the upper lid panel 42.

Referring to FIG. 1, the lid handle 60 may protrude in a forward direction from a front surface of the lid assembly 40. The lid handle 60 may be longitudinally disposed along a left-right width direction of the lid assembly 40, and may increase in a forward protruding length as the lid handle 60 extends from left and right sides to a central portion thereof, forming a substantially rounded shape. Accordingly, as the lid handle 60 may be provided over a whole front side of the lid assembly 40, a convenience in use may increase.

Figure 4:
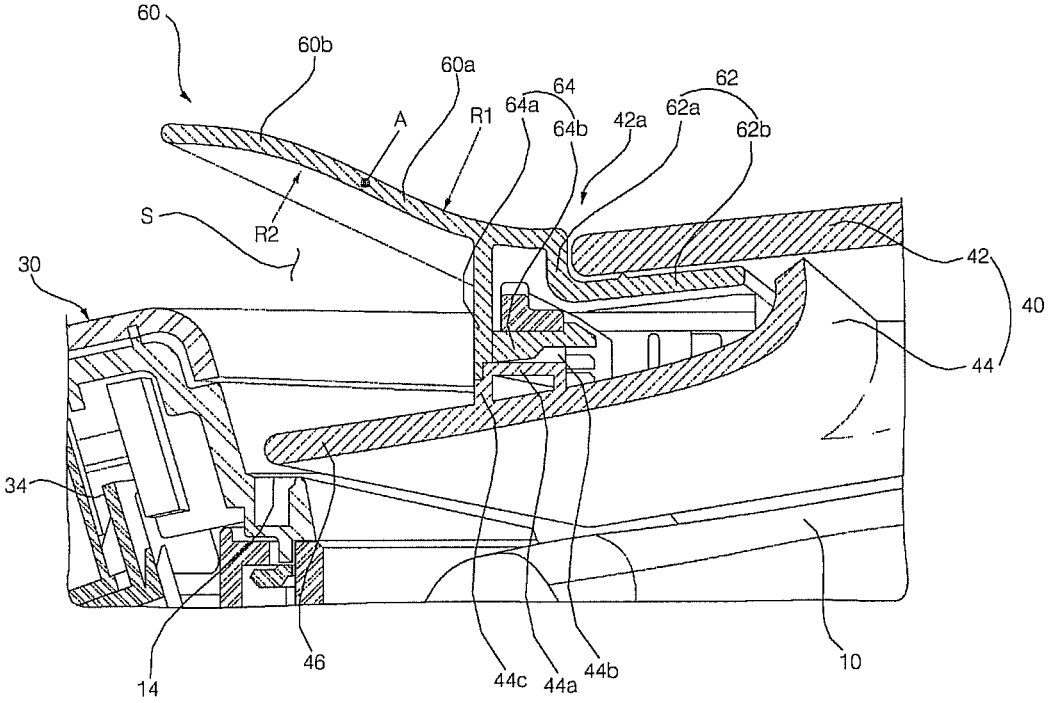
FIG. 4 is a cross-sectional view illustrating a lid handle according to an embodiment.

Referring to FIGS. 3 and 4, the lid handle 60 may protrude upwardly from the top surface of the lid assembly 40, forming a gap S to receive a hand of a user between the lid handle 60 and the control panel 30. A rear portion of the control panel 30 may be provided at a lower front side of the gap S, as shown in FIGS. 3 and 4.

In this embodiment, the lid handle 60 is illustrated as being upwardly inclined with respect to the top surface of the lid assembly 40; however, embodiments are not limited thereto. That is, the lid handle 60 may have any shape that can form a gap S between the lid handle 60 and the control panel 30. For example, the lid handle 60 may protrude upwardly and then may be bent forward.

Referring to FIG. 4, the lid handle 60 may be formed to have a curved shape in which a cross-section thereof has an inflection point A. That is, the lid handle 60 may include a first rounded portion 60*a*, which may be concave with a first radius of curvature R1 and a second rounded portion 60*b*, which may be convex with a second radius of curvature R2 extending from the first rounded portion 60*a*. The first rounded portion 60*a* and the second rounded portion 60*b* may be connected to each other at the inflection point A. The first rounded portion 60*a* may be formed to be concave in the first radius of curvature R1 so as to smoothly extend from the top surface of the lid assembly 40. The second rounded portion 60*a* may be formed to be convex so as to form the gap S, which may be sufficient for the hand of a user to enter. The first radius of curvature R1 and the second radius of curvature R2 may be set equal to each other or different from each other.

The lid handle 60 may be formed of a separate member different from that of the lid assembly 40, and then may be coupled to the lid assembly 40, or may be formed integrally with the lid assembly 40 to extend from the front side of the lid assembly 40. In this embodiment, the lid handle 60 is illustrated as being fixedly coupled to the lid assembly 40.

The lid handle 60 may be fixedly coupled to at least one of the upper lid panel 42 or the lower lid panel 44. In this embodiment, the lid handle 60 is illustrated as being fitted into the upper lid panel 42 and fixedly coupled to the lower lid panel 44 by a hook. The lid handle 60 may include a stepped portion 62, which may be fitted into the upper lid panel 42 and a hook coupling portion 64, which may be fixedly coupled to the lower lid panel 44 by a hook.

The stepped portion 62 may be downwardly stepped at a rear side of the first rounded portion 60*a* of the lid handle 60 to be fitted into a front lower portion 42*a* of the upper lid panel 42. The stepped portion 62 may include a downwardly protruding portion 62*a* that protrudes downwardly from the first rounded portion 60*a* and a backwardly bent portion 62*b* that is backwardly bent from the downwardly protruding portion 62*a*. The backwardly bent portion 62*b* may be fitted into a lower side of the front lower portion 42*a* of the upper lid panel 42.

The hook coupling portion may include a rib 64*a* that protrudes downwardly from the first rounded portion 60*a* and a hook 64*b* that protrudes backwardly from the rib 64*a*. The hook 64*b* may be coupled to a hook hole 44*b* of the lower lid panel 44. The hook hole 44*b* may be formed in a coupling portion 44*a* that protrudes upwardly from the lower lid panel 44. The lower lid panel 44 may further include a stopping portion 44*c* at which a lower end of the rib 64*a* may be stopped in forward and backward directions.

Referring to FIG. 4, the washing machine may further include a leakage preventing portion 46, which may be disposed in the gap S to prevent moisture or heat from leaking to the outside through the laundry loading hole 10*a*. The leakage preventing portion 46 may be a rib that extends from a lower part of the lower lid panel 44 into the gap S. The leakage preventing portion 46 may have a forward protrusion length shorter than that of the lid handle 60. Also, a stepped part 14 may be formed in the top cover 10. A front end portion of the leakage preventing portion 46 may be seated in the stepped portion 14.

Hereinafter, an operation of the lid handle of the washing machine configured as discussed above and according to embodiments will be described as follows.

When laundry is loaded before operation of the washing machine, or laundry is unloaded after completion of washing, a user may grip the lid handle 60 to lift the lid assembly 40 or may put his/her fingers into the gap S under the lid handle 60 to lift the lid handle 60. As an upper front side of die gap S is open when the lid assembly closes the laundry loading hole, as shown in FIGS. 3 and 4, and the lid handle 60 has a shape that protrudes forward and upward, it is very easy for a user to grip and lift the lid handle 60. Also, as the second rounded portion 60*b* of the lid handle 60 has a convex shape, it is very easy for a user to grip or lift the lid handle 60 with his/her fingers.

As the gap S may be formed between the lid assembly 40 and the control panel 30, a user may easily put his/her hand into the gap S. Also, as the leakage preventing portion 46 may be disposed in the gap S, moisture and heat may be prevented from leaking to the outside during operation of the washing machine.

As a laundry treatment machine according to embodiments may include a lid handle that protrudes forward and upward from a front side of a lid assembly and a gap may be formed between the lid handle and a control panel, it is easy for a user to grip the lid handle with his/her hand or insert his/her fingers into the gap to lift the lid handle, and thus convenience in use may be improved.

Also, as the lid handle according to embodiments may be longitudinally formed at the front side of the lid assembly in a left-right width direction, a user may conveniently grip the lid handle, and aesthetics may be secured. Further, as a leakage preventing portion may be disposed in the gap, internal moisture and heat may be prevented from leaking to the outside.

Embodiments disclosed herein provide a laundry treatment machine including a lid assembly, which may secure convenience in use and aesthetics.

Embodiments disclosed herein provide a laundry treatment machine that may include a top cover disposed over a cabinet and having a laundry loading hole; a control panel disposed at a front upper side of the top cover; a lid assembly disposed over the top cover at a rear side of the control panel to open/close the laundry loading hole; and a lid handle that protrudes forward from a front surface of the lid assembly and protrudes upward compared to a top surface of the lid assembly to form a gap such that a hand of a user may enter the gap between the lid handle and the control panel. The lid handle may be formed to upwardly incline based on the top surface of the lid assembly at the front side of the lid assembly.

The lid handle may have a curved shape in which a cross-section thereof has an inflection point. The lid handle may be longitudinally disposed along a left-right width direction of the lid assembly and may increase in a forward protruding length as the lid handle goes from left and right sides to a central side thereof, forming a rounded shape. The lid handle may include a stepped part or portion that is downwardly stepped so as to be fitted into a front lower portion of the lid assembly.

The lid handle may include a hook coupling part or portion that is coupled to the front lower portion of the lid assembly by a hook. The hook coupling part may include a rib that protrudes downward and the hook, which protrudes backward from the rib, and a hook hole may be formed at a lower portion of the lid assembly to be coupled to the hook.

The laundry treatment machine may further include a leakage preventing part or portion that is disposed at the gap to prevent moisture or heat from leaking from the laundry loading hole. The leakage preventing part may extend from a lower portion of the lid assembly.

The lid assembly may include an upper lid panel that defines an upper exterior thereof and a lower lid panel coupled to a lower side of the lid upper panel to define a lower exterior thereof. The lid handle may include a stepped part that is downwardly stepped so as to be fitted into a lower portion of the upper lid panel and a hook that is coupled to the lower lid panel by a hook.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment machine, comprising:

a top cover provided over a cabinet and having a laundry loading hole;

a control panel provided at a front upper side of the top cover;

a lid assembly provided over the top cover at a rear side of the control panel to open and close the laundry loading hole; and a lid handle that protrudes in a forward direction from the lid assembly to form a gap between the lid handle and the control panel configured to receive a hand of a user when the user grips the lid handle that protrudes in the forward direction, wherein a leakage preventing portion provided at the gap to prevent moisture or heat from leaking from the laundry loading hole, wherein the leakage preventing portion protrudes in a forward direction from a lower portion of the lid assembly, wherein a space is formed between the upper surface of the leakage preventing portion and the lower surface of the lid handle that protrudes in the forward direction, wherein a rear portion of the control panel is disposed at a lower front side of the space, wherein an upper front side of the space is open when the lid assembly closes the laundry loading hole, wherein the lid handle includes:

a protruding portion that protrudes in the forward direction from a front portion of the lid assembly, a stepped portion that is downwardly stepped from the protruding portion and extends in a rearward direction so as to be fitted under the front portion of the lid assembly, and a coupling portion that is coupled to the lid assembly.

2. The laundry treatment machine of claim 1, wherein the lid handle is formed to incline upwardly with respect to the top surface of the lid assembly at a front side of the lid assembly.

3. The laundry treatment machine of claim 1, wherein the lid handle has a curved shape.

4. The laundry treatment machine of claim 3, wherein a cross-section of the lid handle has an inflection point.

5. The laundry treatment machine of claim 4, wherein the lid handle includes a first curved portion, and a second curved portion that extends from the first curved portion.

6. The laundry treatment machine of claim 5, wherein the first curved portion and the second curved portion are connected to each other at the inflection point.

7. The laundry treatment machine of claim 6, wherein the first curved portion is convex and the second curved portion is concave.

8. The laundry treatment machine of claim 7, wherein a first radius of curvature of the first curved portion is the same as a second radius of curvature of the second curved portion.

9. The laundry treatment machine of claim 7, wherein a first radius of curvature of the first curved portion is different than a second radius of curvature of the second curved portion.

10. The laundry treatment machine of claim 1, wherein the lid handle extends longitudinally in a widthwise direction of the lid assembly, and wherein a forward protruding length of the lid handle increases as the lid handle extends from lateral sides to a central side thereof, forming a rounded shape.

11. The laundry treatment machine of claim 1, wherein the coupling portion is coupled to a front lower portion of the lid assembly by a hook.

12. The laundry treatment machine of claim 1, wherein the lid assembly includes an upper lid panel that defines an upper exterior thereof and a lower lid panel coupled to a lower side of the upper lid panel to define a lower exterior thereof.

13. The laundry treatment machine of claim 1, wherein a front end portion of the leakage preventing portion is seated in the stepped portion.

14. The laundry treatment machine of claim 1, wherein the leakage preventing portion is configured to open the front portion of the laundry loading hole when the lid assembly opens the laundry loading hole.

15. The laundry treatment machine of claim 1, wherein the leakage preventing portion is configured to close the front portion of the laundry loading hole when the lid assembly closes the laundry loading hole.

16. The laundry treatment machine of claim 12, wherein the leakage preventing portion includes a rib that extends from the lower lid panel into the gap between the lid handle and the control panel.

17. The laundry treatment machine of claim 1, wherein the lid handle extends from a first end to a second end, wherein the lid handle includes a first point between the first end and the second end, the first point of the lid handle being adjacent to an end of the front portion of the lid assembly, and the stepped portion of the lid handle to extend from the first point of the lid handle to the first end of the lid handle.

18. A laundry treatment machine, comprising:

a top cover provided over a cabinet and having a laundry loading hole;

a control panel provided at a front upper side of the top cover;

a lid assembly provided over the top cover at a rear side of the control panel to open and close the laundry loading hole, and a lid handle that protrudes in a forward direction from the lid assembly to form a gap between the lid handle and the control panel configured to receive a hand of a user when the user grips the lid handle that protrudes in the forward direction, wherein a leakage preventing portion provided at the gap to prevent moisture or heat from leaking from the laundry loading hole, wherein the leakage preventing portion protrudes in a forward direction from a lower portion of the lid assembly wherein a space is formed between the upper surface of the leakage preventing portion and the lower surface of the lid handle that protrudes in the forward direction, wherein a rear portion of the control panel is disposed at a lower front side of the space, wherein an upper front side of the space is open when the lid assembly closes the laundry loading hole, wherein the lid handle that protrudes in the forward direction includes a hook coupling portion, wherein the hook coupling portion includes a rib that protrudes downward from a main portion of the lid handle, and a hook that protrudes in a backward direction from the rib, wherein the hook coupling portion further includes a hook hole formed at or in a lower portion of the lid assembly to be coupled to the hook that protrudes in the backward direction from the rib.

19. The laundry treatment machine of claim 18, wherein the hook hole is formed in a coupling portion that extends upward from a lower lid panel of the lid assembly.

20. The laundry treatment machine of claim 19, wherein the coupling portion includes a stopping portion that limits movement of the rib.

* * * * *